US005662564A

United States Patent [19]

Nelson

[11] Patent Number: 5,662,564

[45] Date of Patent: Sep. 2, 1997

[54] EXERCISE DEVICE

[76] Inventor: Keith A. Nelson, 4555 Sawmill School Rd., Granite Falls, N.C. 28630

[21] Appl. No.: 648,389

[22] Filed: May 15, 1996

[51] Int. Cl.[6] ..... A63B 21/02

[52] U.S. Cl. ..... 482/129; 482/121

[58] Field of Search ..... 482/121, 123, 482/129, 130

[56] References Cited

U.S. PATENT DOCUMENTS

| | | | |
|---|---|---|---|
| 3,747,593 | 7/1973 | Taylor . | |
| 3,830,493 | 8/1974 | Miller . | |
| 4,033,580 | 7/1977 | Paris . | |
| 4,193,593 | 3/1980 | Wilson . | |
| 4,371,162 | 2/1983 | Hartzell . | |
| 4,685,670 | 8/1987 | Zinkin . | |
| 4,690,402 | 9/1987 | Basting . | |
| 4,733,862 | 3/1988 | Miller . | |
| 4,911,436 | 3/1990 | Lighter . | |
| 5,074,551 | 12/1991 | Olschansky et al. | 482/130 |
| 5,128,878 | 7/1992 | Wingate et al. . | |
| 5,160,303 | 11/1992 | Smith . | |
| 5,320,591 | 6/1994 | Harmon et al. . | |
| 5,397,288 | 3/1995 | Sayre . | |

*Primary Examiner*—L. Reichard

[57] ABSTRACT

An exercise device includes a base having a support column vertically extending therefrom. A handle assembly is rotatably mounted to one side of the column about a horizontal axis passing through the column. The handle assembly is linked to a first swingable housing on the opposed side of the column with rotation of the handle assembly causing a swingable movement of the first housing. An elastic band extends from the first housing and is wound about guide pins in a second housing fixed to the column so that movement of the first housing is resisted by the elastic band. The tension of the band is regulated by first and second band take up reels in the first housing, the reels being rotatable by a dial extending from the first housing. Rotation of the reels winds or unwinds the band ends therefrom so as to increase or decrease the tension in the elastic.

20 Claims, 8 Drawing Sheets

EXERCISE DEVICE

BACKGROUND OF THE INVENTION

This invention relates to an exercise device and, more particularly, to a unit for exercising various muscle groups particularly that of the upper torso against resistance offered by an adjustable tensioning apparatus.

A variety of exercise devices are utilized so as to build and/or tone muscles by offering resistance to the user's movements during performance of the exercise. Such devices include weight, hydraulic and pneumatic systems as well as springs, rubber bands and other elastics which resist the movement of selected body parts of the user.

Accordingly, a cost-effective exercise device which can be used by persons of varying strengths is desired. Thus, a device which offers a regulated resistance to the user according to the strength and/or muscle tone of the user is preferred.

In response thereto I have invented an exercise device which utilizes a rotatable handle assembly, the assembly rotation being resisted by an elastic band. The elastic band extends between upper and lower housings, the upper housing having a plurality of take up reels therein for regulating the tension of the elastic band. Rotation of the handle assembly by the user swings the upper housing about an axis, such upper housing movement being resisted by the associated elastic band extending between the swingable upper housing and a lower fixed housing. Various exercises can thus be performed by the user, the resistance offered to the user being adjustable either by regulating the tension of the elastic band or replacement of the entire band.

Accordingly, it is a general object of this invention to provide an exercise device presenting a regulated resistance to the user.

Another object of this invention is to provide a device, as aforesaid, the resistance being adjustable by the user.

Another particular object of the invention is to provide a device, as aforesaid, the resistance being in the form of an elastic band which can be replaced by the user.

A still more particular object of this invention is to provide a device, as aforesaid, including a handle assembly rotated by the user with user rotation of the assembly being resisted by a tensioned elastic extending between an upper swingable housing and a lower fixed housing.

A further object of this invention is to provide a device, as aforesaid, the tension of the elastic being easily regulated by rotation of take up reels located within the upper housing.

Still a further particular object of this invention is to provide a device, as aforesaid, the movement of the upper housing being caused by rotation of the handle assembly.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
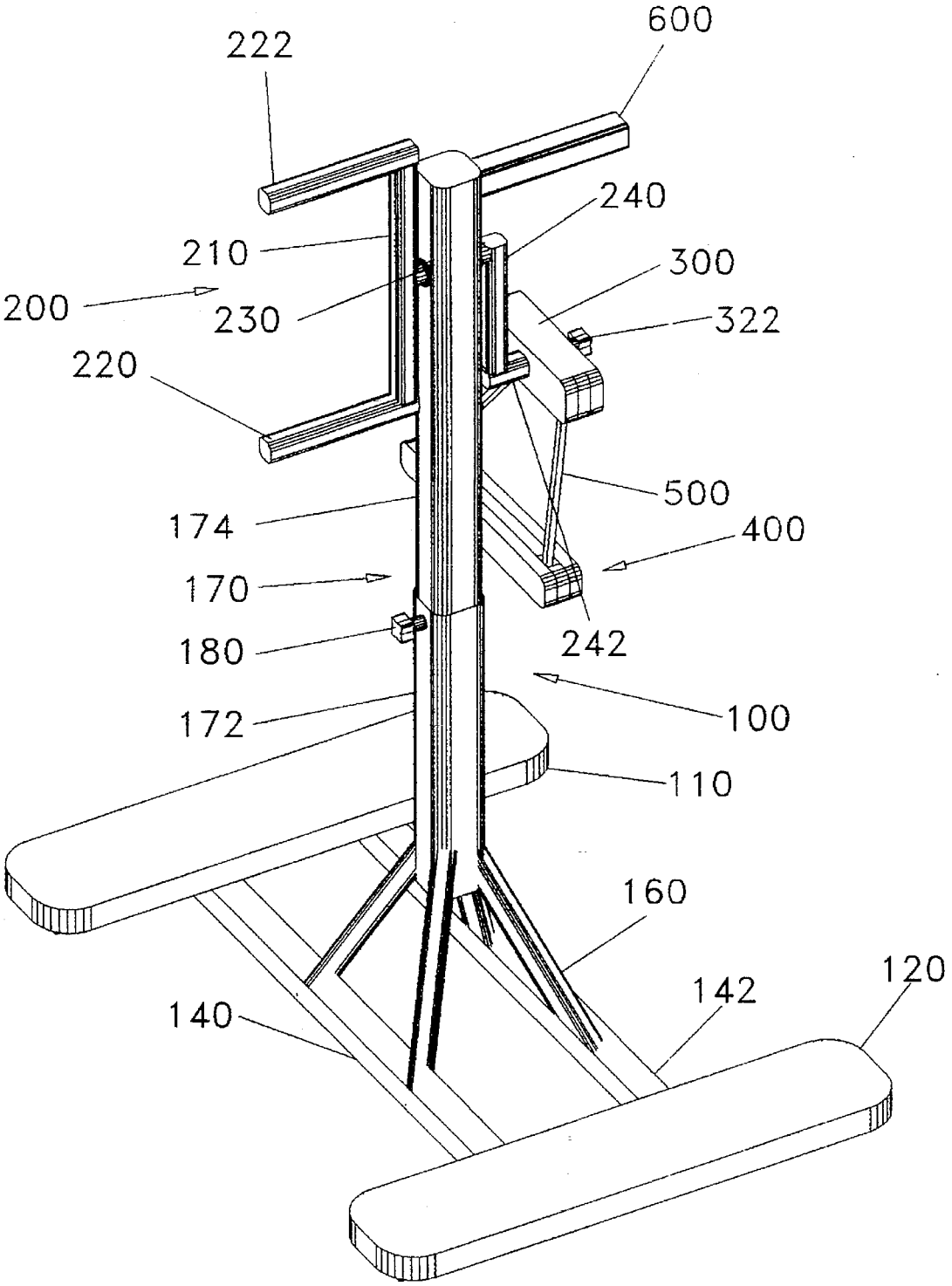
FIG. 1 is a perspective view of the exercise device.
Figure 2:
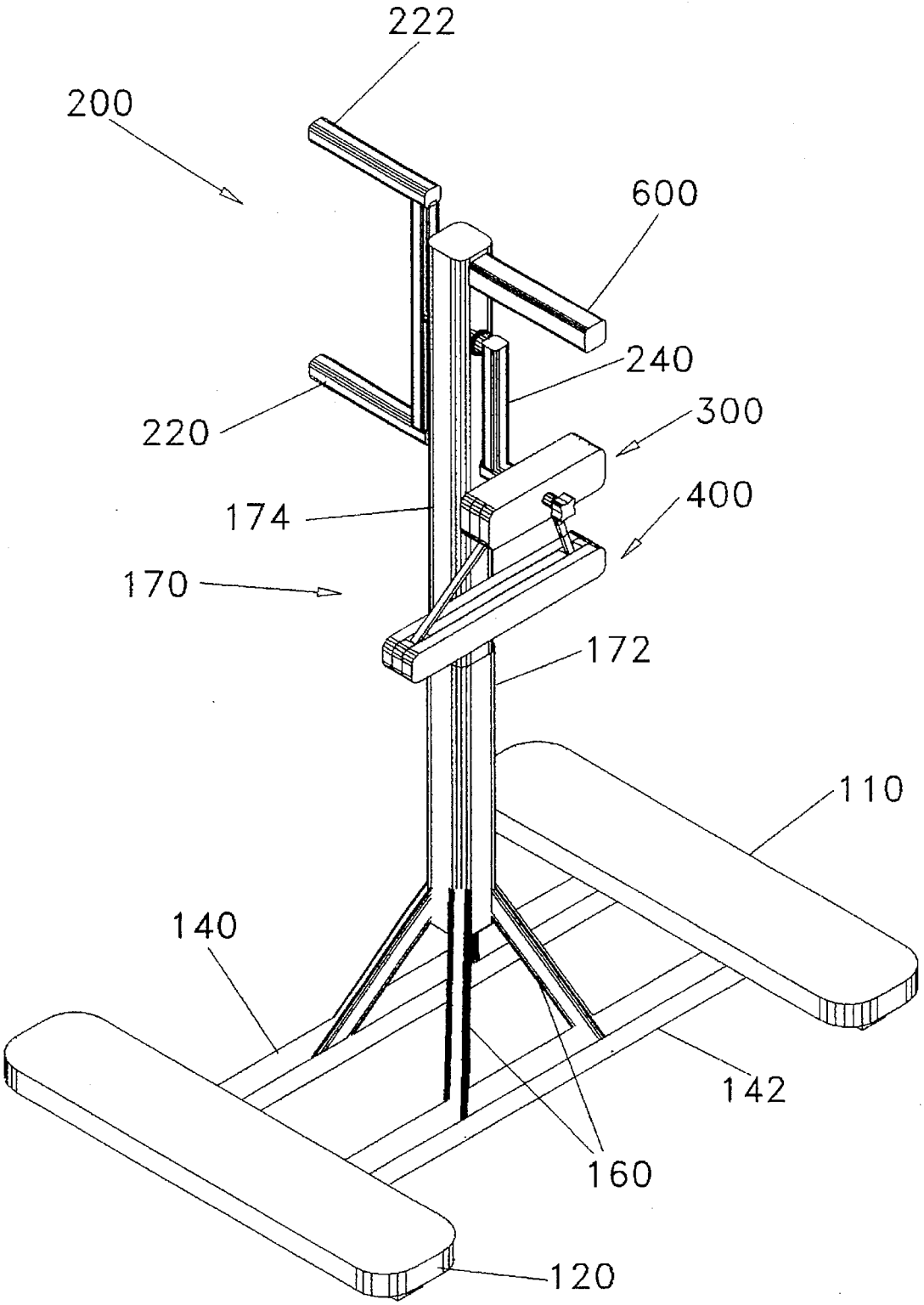
FIG. 2 is a perspective view of the exercise device of FIG. 1 from the opposed side thereof.
Figure 3:
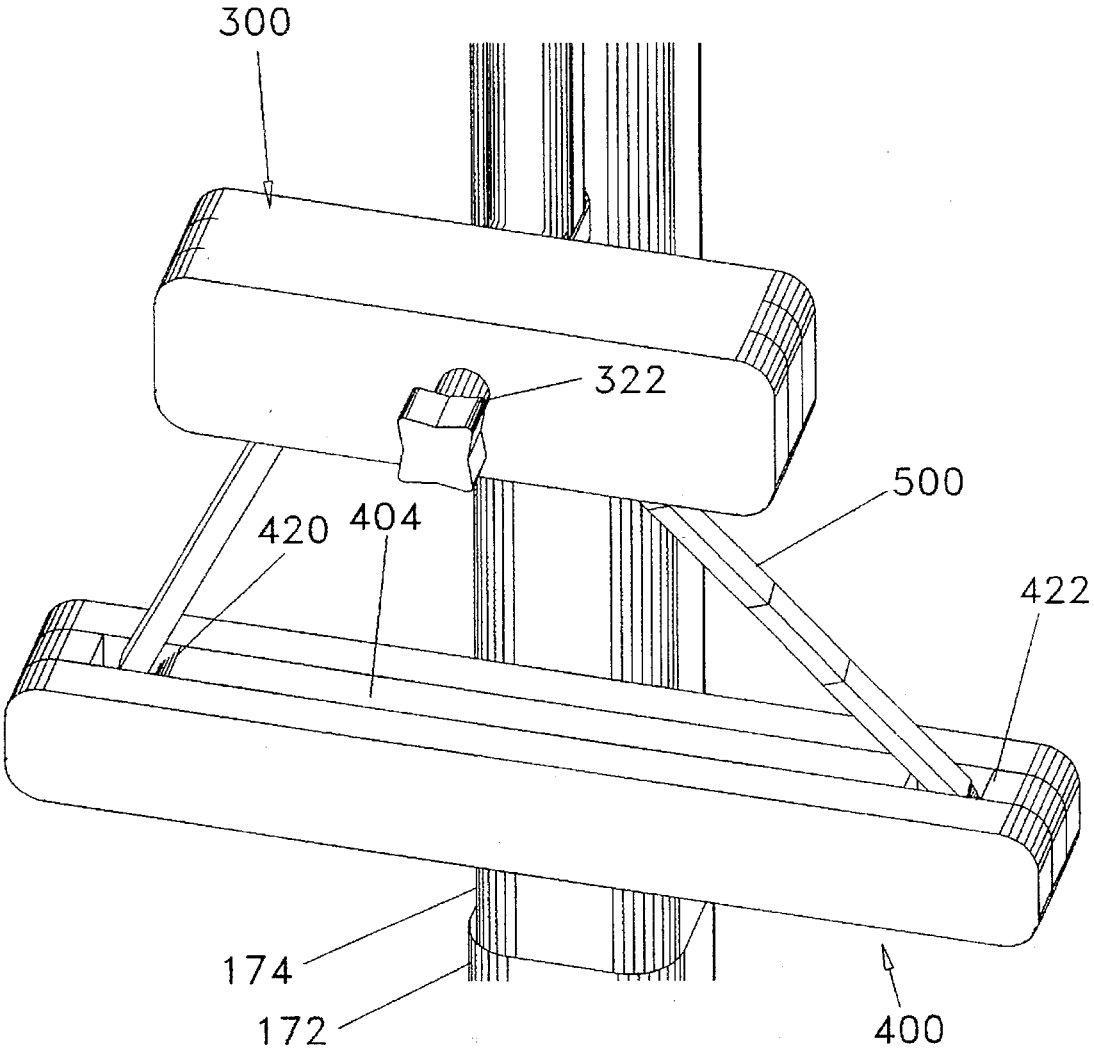
FIG. 3 is a fragmentary view of the upper and lower housings of the exercise device on an enlarged scale.

Turning more particularly to the drawings, FIG. 1 illustrates a now preferred embodiment of the exercise device. The exercise device comprises a frame assembly 100 presenting a base in the form of two ground-adjacent pads 110, 120 with struts 140, 142 extending therebetween. A vertical support column 170 is attached to struts 140, 142 by a plurality of upwardly extending struts 160 extending between the bottom of the column 170 and struts 140, 142.

Column 170 includes a lower sleeve 172 with an upper sleeve 174 slidable therein. A pin 180 extends through sleeve 172 and bears against Sleeve 174, the pin maintaining the relative vertical displacement between the lower 172 and upper 174 sleeves. Accordingly, the height of the overall column 170 can be regulated by the user.

Rotatably attached to one side of column 170 is a user-operable, handle assembly 200. This assembly 200 comprises an arm 210 with a pair of handles 220, 222 normally extending therefrom. A shaft 230 extends from arm 210 and through sleeve 174. The opposed end of shaft 230 is attached to an arm 240 positioned on the opposed side of column 170. Extending from the lower arm end of arm 240 is a shaft 242, the end of shaft 242 being attached to a rear wall of housing 300. Accordingly, exertion on either handle 220, 222 of handle assembly 200 rotates shaft 230 and arm 240 attached thereto. This movement swings arm 242 and attached housing 300 about a longitudinal axis extending through shaft 230.

Positioned within housing 300 are rotatable reels/sprockets 310, 330 with a sprocket 320 positioned therebetween. Sprocket 320 is user-rotatable by means of a dial 322 extending from the front wall 302 of housing 300 and coupled to shaft 321 of sprocket 320. The cogs on sprocket 320 mesh with cogs on the sprockets 310, 330. Accordingly, rotation of the sprocket 320 in clockwise or counterclockwise directions will rotate the adjacent sprockets 310, 330 in opposed directions.

Mounted to column 170 and below the housing 300 is a guide housing 400. Located within housing 400 are a pair of guide pins 410, 412 as positioned below apertures 420, 422 located in the top wall 404 of the housing 400. An elastic band 500 has first 510 and second 530 end portions respectively wound about the sprockets 310, 330. The band ends 510, 530 extend from these sprockets 310, 330 and through an opening 340 in the bottom wall 302 of housing 300. The band ends further extend through apertures 420, 422 in the top wall 404 of a housing 400, as fixed to column 170, and about the guide pins 410, 412.

Figure 4:
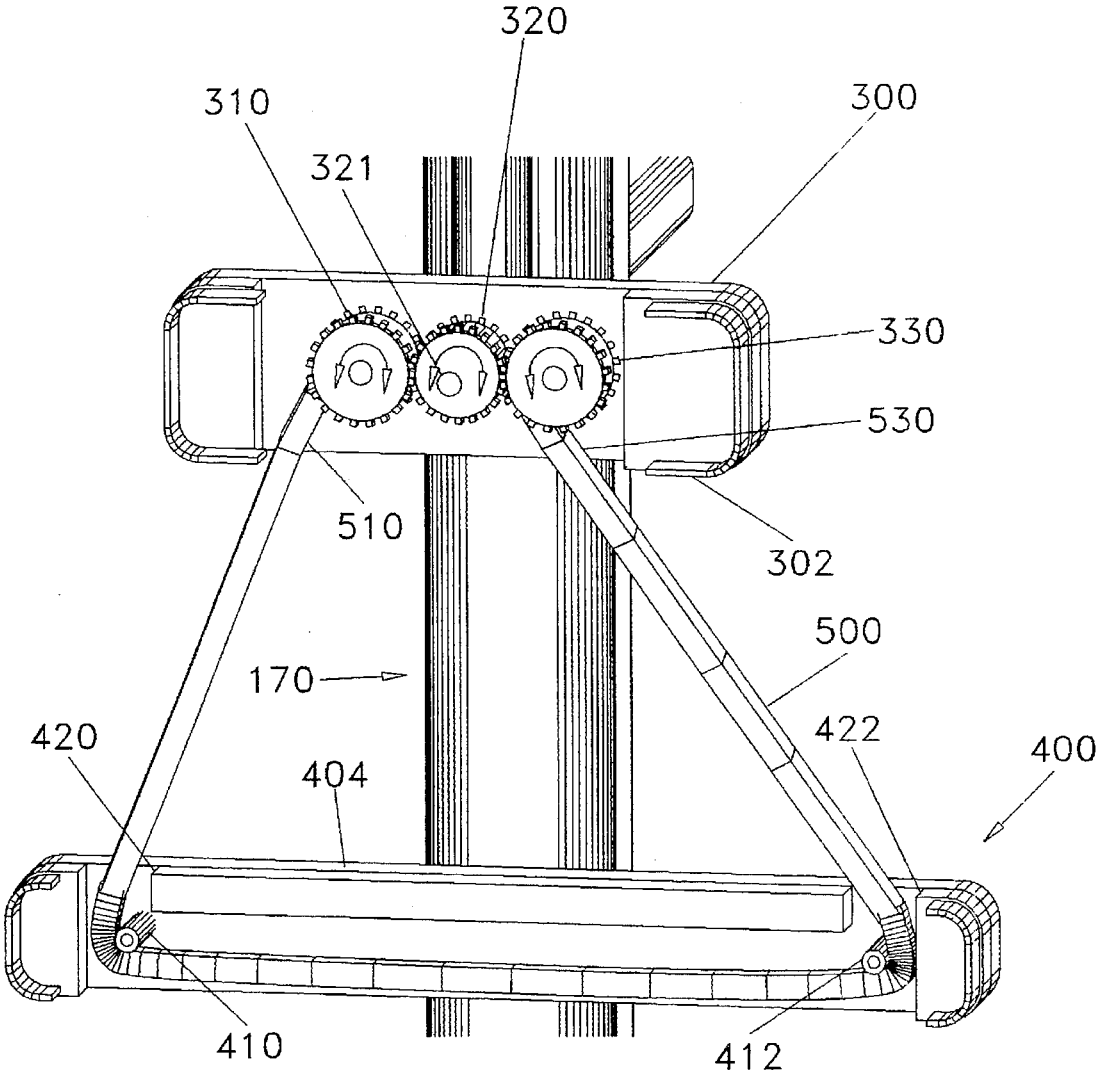
FIG. 4 is a fragmentary view, similar to that of FIG. 3, with the covers of the upper and lower housings removed.
Figure 5:
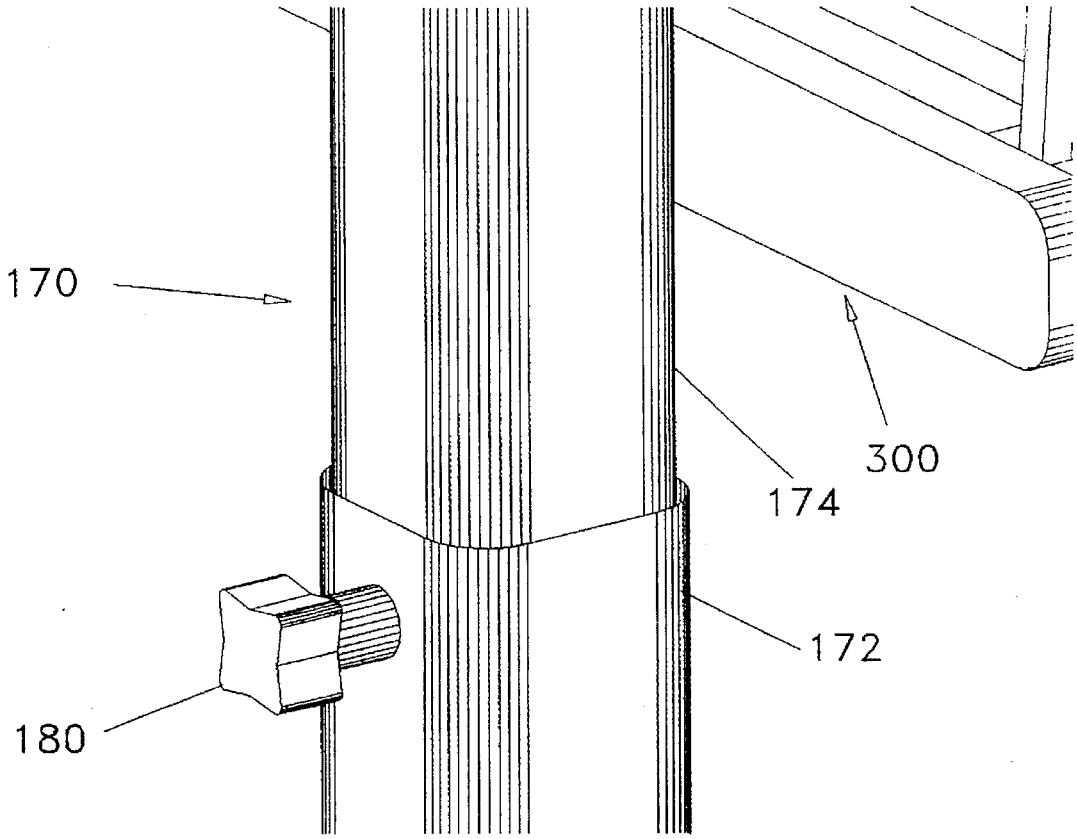
FIG. 5 is a fragmentary view of the vertical column of the exercise device showing the adjustability between the upper and lower sleeves.
Figure 6:
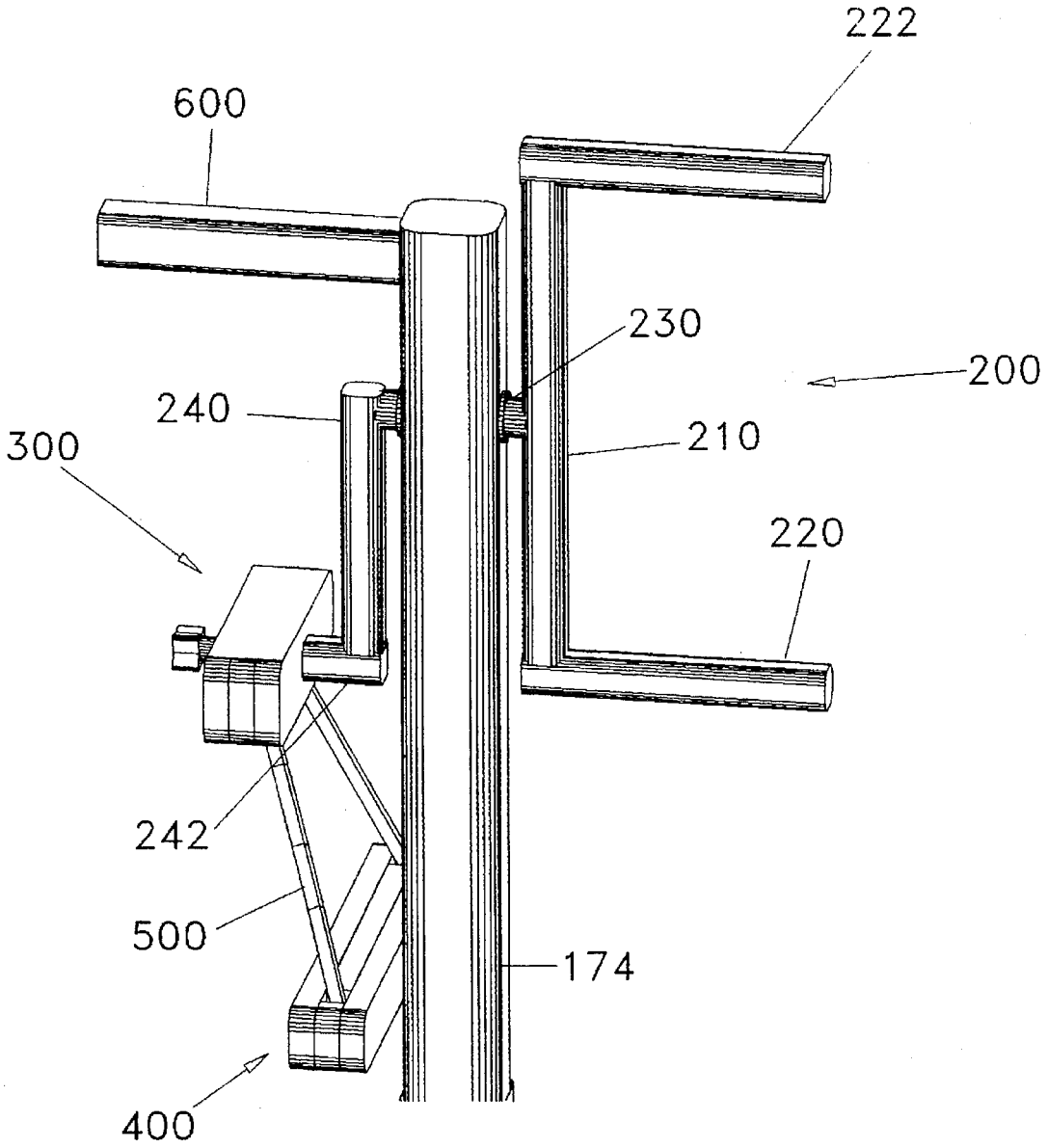
FIG. 6 is a front fragmentary view of the exercise device showing the rotatable arm, the hand rest and the upper and lower housings with the tensioned elastic extending therebetween.
Figure 7:
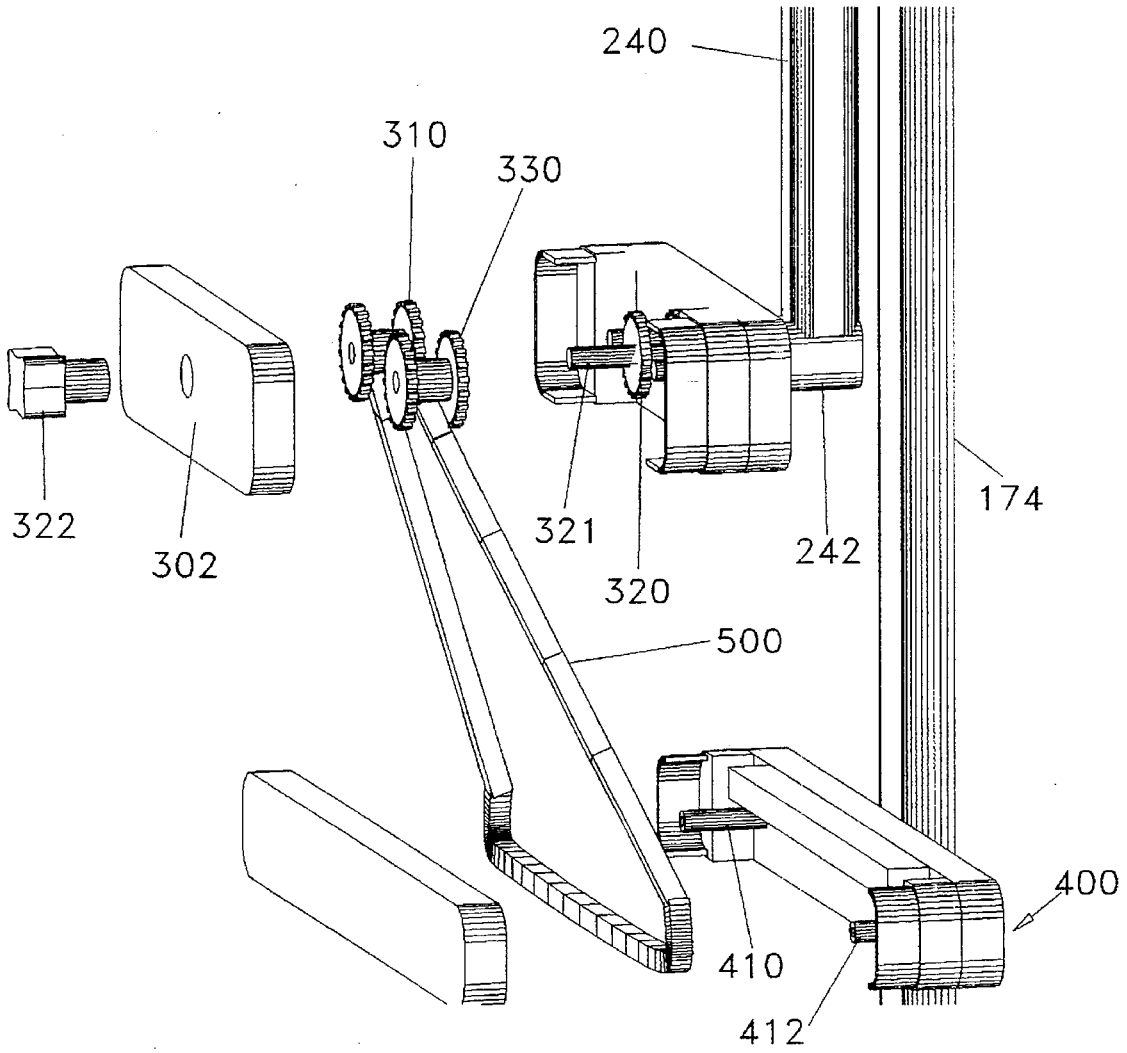
FIG. 7 is an exploded view of the upper and lower housings of the exercise device.
Figure 8:
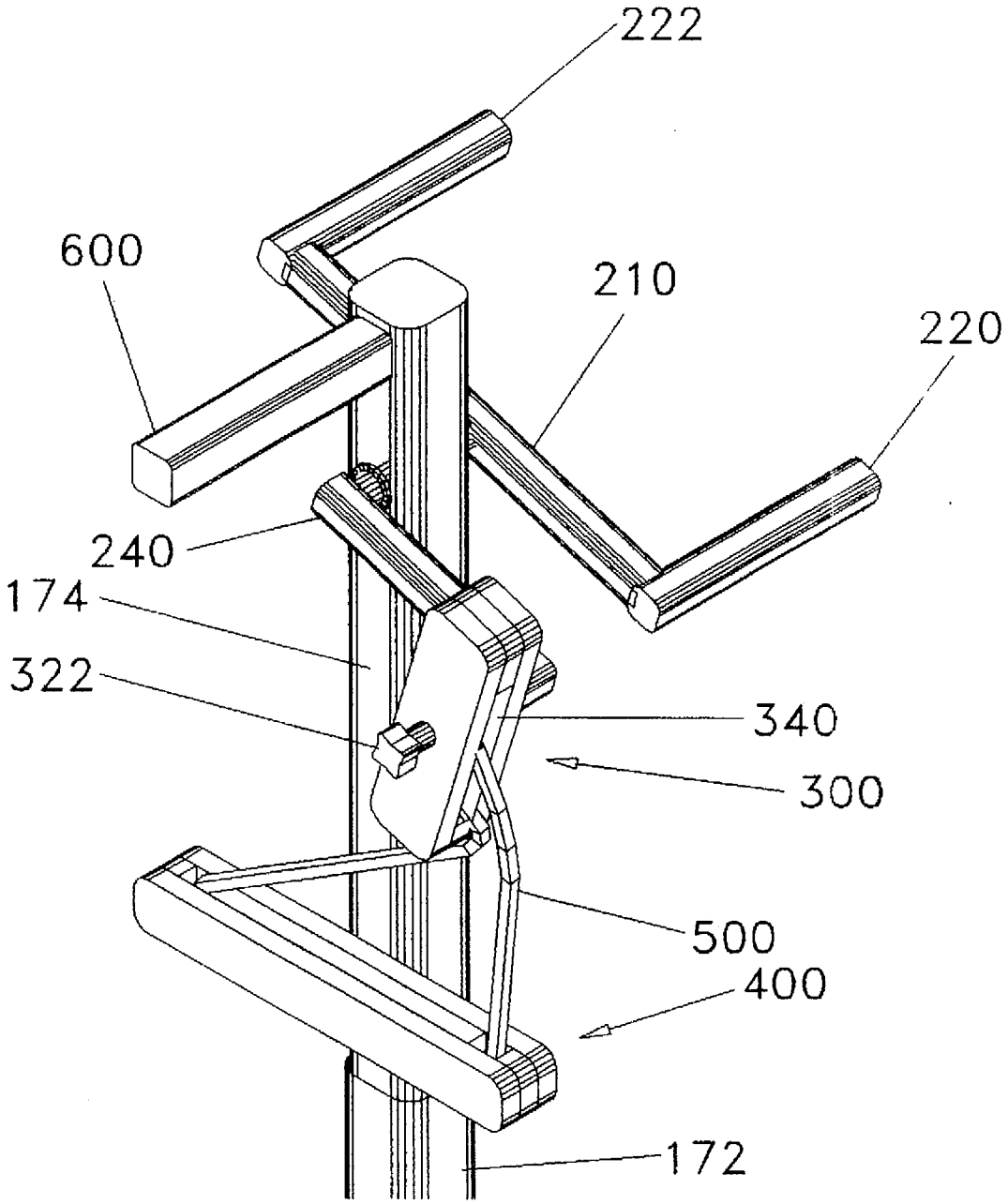
FIG. 8 is a perspective view of the upper portion of the exercise device showing the operable elements thereof.

As shown in FIG. 4, the tension of the elastic band 500 can be regulated by rotation of sprocket 320 via rotation of the dial 322. Rotation of sprocket 320 in a counterclockwise direction rotates the sprockets 310, 330 in a clockwise direction which will wind the respective ends 510, 530 of the band 500 about the respective sprockets 310, 330. As the band is wound about fixed guide pins 410, 412, the tension in the band 500 will increase. Rotation of the dial 322 and sprocket 320 in an opposed, clockwise direction will rotate the sprockets 310 and 330 in a counterclockwise direction which will unwind the band ends 510, 530 from their respective sprockets 310, 330. Such unwinding will decrease the tension in the band 500 extending between the upper 300 and lower 400 housings.

In one form of exercise the user approaches the exercise device and rests one hand on a hand rest 600 normally extending from the top of the vertical column 170. Upon grasping one of the handles 220, 222 of the handle assembly 200, the user rotates the handles 220, 222 in either clockwise or counterclockwise directions. Shaft 230 then rotates which will ultimately swing the upper housing 300 about an axis passing through shaft 230. This housing 300 movement is resisted by the elastic band 500 extending between the upper 300 and lower 400 housings, the degree of such resistance depending on the tension in the elastic band 500. Accordingly, resistance is presented to the user through the handle assembly 200, such resistance being transferred to the body part being exerted against the handle assembly 200.

Thus, various exercises can be performed by grasping either of the handles 220, 222 of handle assembly 200 with either hand. The adjustability of the height of the column 170 allows the user to exert a leg, foot or other body part against the handle assembly 200 in an attempt to rotate the handle assembly 200. Thus, my invention is not to be limited to exertion of any specific body part against the handle assembly 200 or to any specific exercise position relative to the handle assembly 200.

It is to be understood that while a certain form of this invention has been illustrated and described, it is not limited thereto except insofar as such limitations are included in the following claims and allowable functional equivalents thereof.

Having thus described the invention, what is claimed as new and desired to be secured by Letters Patent is as follows:

1. An exercise device comprising:

a base;

a column extending from said base;

a handle rotatably mounted to one side of said column, said handle rotatable about an axis extending through said column upon exertion of pressure by a body part of a user against said handle;

a shaft attached to said handle and extending through said column for rotation therewith;

a first housing;

means for mounting said first housing to said shaft on a side of said column opposite said handle, the rotatable movement of said shaft causing said first housing to swing in movement about an imaginary axis passing through said column;

a second housing attached to said column and spaced from said first housing; and an elastic extending between said housings, said elastic resisting said movement of said first housing and said handle coupled thereto, said handle resistance resisting movement of a body part exerting pressure against said handle.

2. The device as claimed in claim 1 wherein said column comprises:

a first sleeve;

a second sleeve slidable within said first sleeve; means on said second sleeve for holding said second sleeve in a position relative to said first sleeve.

3. The device as claimed in claim 1 wherein said handle comprises:

an arm;

said shaft extending from said arm and through said column, said axis of handle rotation passing through said shaft;

at least one bar extending from said arm for exertion of a body part thereon.

4. The device as claimed in claim 3 wherein said first housing mounting means comprises:

a second arm mounted to an end of said shaft;

a second shaft extending from an end of said second arm and attached to said first housing.

5. The device as claimed in claim 1 further comprising means in said first and second housings for regulating a tension of said elastic extending therebetween.

6. The device as claimed in claim 5 wherein said regulating means comprises:

at least one pin within said second housing for guiding a portion of said elastic therearound;

a first reel in said first housing for wrapping a first end of said elastic therearound;

a second reel in said first housing for wrapping a second end of said elastic therearound;

means in said first housing for rotating said reels in first or second opposed directions, said first direction of said reels winding said elastic ends therearound to increase the tension in said elastic with a second opposed direction of said reels unwinding said elastic ends to decrease said tension.

7. The device as claimed in claim 6 wherein said rotating means comprises:

a plurality of cogs about a circumference of said first and second reels;

a third reel positioned between said first and second reels and having means thereon for meshing with said cogs on said first and second reels;

a dial on said third reel and positioned outside said first housing, a rotation of said dial rotating said third reel and said meshed first and second reels in said first or second directions.

8. An exercise device comprising:

a base;

a frame vertically extending from said base;

a handle rotatably mounted to said frame, said handle rotatable about an axis extending through said frame upon exertion of pressure by a body part of a user against said handle;

a first housing;

linkage means between said handle and said first housing for mounting said first housing on said frame in movement with said handle, the rotatable movement of said handle transferred through said linkage means for causing said first housing to swing in first or second directions relative to said frame;

a second housing attached to said frame and spaced from said first housing; and an elastic extending between said housings, said elastic resisting said movement of said first housing and said handle linked thereto, said handle resisting movement of a body part exerting pressure thereon.

9. The device as claimed in claim 8 wherein said frame comprises:

a first sleeve;

a second sleeve slidable within said first sleeve;

means on said second sleeve for holding said second sleeve in a position relative to said first sleeve.

10. The device as claimed in claim 8 wherein said handle comprises:

an arm;

a shaft extending from said arm and through said frame, said axis of handle rotation passing through said shaft;

at least one bar extending from said shaft for exertion of a body part thereon.

11. The device as claimed in claim 10 wherein said linkage means comprises:

a second arm mounted to an end of said shaft;

a second shaft extending from an end of said second arm and attached to said first housing.

12. The device as claimed in claim 8 further comprising means in said first and second housings for regulating a tension of said elastic extending therebetween.

13. The device as claimed in claim 12 wherein said regulating means comprises:

at least one pin within said second housing for guiding a portion of said elastic therearound;

a first reel in said first housing for wrapping a first end of said elastic therearound;

a second reel in said first housing for wrapping a second end of said elastic therearound;

means in said first housing for rotating said reels in first or second opposed directions, said first direction of said reels winding said elastic ends therearound to increase the tension in said elastic with a second opposed direction of said reels unwinding said elastic ends to decrease said tension.

14. The device as claimed in claim 13 wherein said rotating means comprises:

a plurality of cogs about a circumference of said first and second reels;

a third reel positioned between said first and second reels and having cogs thereon for meshing with said cogs on said first and second reels;

a dial on said third reel and positioned outside said first housing, a rotation of said dial rotating said third reel and said first and second reels in said first or second directions.

15. An exercise device comprising:

a framework vertically extending from an underlying support surface;

a first housing;

means for mounting said first housing to said framework in swingable movement relative thereto;

rotatable handle means coupled to said framework and said first housing for exertion of pressure by a body part of a user thereon, a rotatable movement of said handle means urging said first housing coupled thereto through said relative swingable frame movement;

a second housing fixed to said framework and spaced from said first housing; and tension means extending between said housings for resisting said movements of said first housing and said handle means coupled thereto, whereby to resist movement of a body part exerting pressure against said handle means.

16. The device as claimed in claim 15 wherein said tension means is an elastic extending between said first and second housings.

17. The device as claimed in claim 16 further comprising means for regulating a tension of said elastic, said regulating means comprises:

guide means within said second housing for directing a portion of said elastic therethrough;

at least a first reel in said first housing for wrapping a first end of said elastic therearound;

means in said first housing for attaching an opposed end of said elastic thereto;

means in said first housing for rotating said at least first reel in first or second opposed directions, said first direction winding said first elastic end therearound to increase the tension in said elastic with a second opposed direction of said reel unwinding said first elastic end to decrease said tension.

18. The device as claimed in claim 17 wherein said rotating means comprises:

a plurality of cogs about a circumference of said at least first reel;

a dial in said first housing and having means thereon for meshing with said cogs on said at least first reel;

handle means on said dial for rotating said dial and positioned on said first housing, a rotation of said dual handle means rotating said dial and said at least first reel meshed therewith.

19. An exercise device comprising:

a framework vertically extending from an underlying support surface;

a first housing;

means for mounting said first housing to said framework in movement relative thereto;

handle means for exertion of pressure by a body part of a user thereon, a movement of said handle means urging said first housing through said relative frame movement;

a second housing fixed to said framework and spaced from said first housing; and an elastic extending between said housings, said elastic resisting said movements of said first housing and said handle means, whereby to resist movement of a body part exerting pressure against said handle means;

means in said first and second housings for regulating a tension of said elastic extending therebetween, said means comprising:

guide means within said second housing for a portion of said elastic;

at least a first reel in said first housing for wrapping a first end of said elastic therearound;

means in said first housing for rotating said at least first reel in first or second opposed directions, said first direction winding said elastic end therearound to increase the tension in said elastic with a second opposed direction of said reel unwinding said elastic end to decrease said tension.

20. The device as claimed in claim 19 wherein said rotating means comprises:

a plurality of cogs about a circumference of said at least first reel;

a dial in said first housing and having means thereon for meshing with said cogs on said at least first reel;

handle means on said dial for rotating said dial and positioned on said first housing, a rotation of said handle means rotating said dial and said at least first reel meshed therewith.

* * * * *